US010411388B2

(12) United States Patent
Wan et al.

(10) Patent No.: US 10,411,388 B2
(45) Date of Patent: Sep. 10, 2019

(54) ELECTRICAL CONNECTOR WITH TERMINALS HAVING SUPPORTING PORTION

(71) Applicant: LOTES CO., LTD, Keelung (TW)

(72) Inventors: Lei Wan, Keelung (TW); Jie Liao, Keelung (TW); Yao Wen Zhong, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/992,354

(22) Filed: May 30, 2018

(65) Prior Publication Data

US 2018/0366857 A1 Dec. 20, 2018

(30) Foreign Application Priority Data

Jun. 15, 2017 (CN) ..... 2017 2 0696545 U

(51) Int. Cl.

| | |
|---|---|
| ***H01R 13/26*** | (2006.01) |
| ***H01R 13/642*** | (2006.01) |
| *H01R 13/717* | (2006.01) |
| *H01R 13/05* | (2006.01) |
| *H01R 24/64* | (2011.01) |

(52) U.S. Cl.

CPC ..... *H01R 13/26* (2013.01); *H01R 13/642* (2013.01); *H01R 13/05* (2013.01); *H01R 13/7175* (2013.01); *H01R 24/64* (2013.01)

(58) Field of Classification Search

CPC ..... H01R 13/26
USPC ..... 439/668, 676
See application file for complete search history.

(56) References Cited

U.S. PATENT DOCUMENTS

| | | | | |
|---|---|---|---|---|
| 5,735,717 A * | 4/1998 | Nabeshima | H01R 13/11 | 439/851 |
| 5,938,479 A * | 8/1999 | Paulson | H01R 4/2433 | 439/676 |
| 6,416,364 B1 * | 7/2002 | Shi | H01R 13/64 | 439/676 |
| 7,238,060 B1 * | 7/2007 | Lee | H01R 13/6658 | 439/676 |

(Continued)

FOREIGN PATENT DOCUMENTS

| | | |
|---|---|---|
| CN | 201112941 Y | 9/2008 |
| CN | 101325299 B | 5/2012 |

*Primary Examiner* — Tulsidas C Patel
*Assistant Examiner* — Peter G Leigh
(74) *Attorney, Agent, or Firm* — Locke Lord LLP; Tim Tingkang Xia, Esq.

(57) ABSTRACT

An electrical connector includes an insulating body provided with an accommodating cavity for insertion of a mating connector; and a plurality of terminals retained in the insulating body. At least one of the terminals has a retaining portion, an extending portion extending forward from the retaining portion, a contact portion bending upward from a front end of the extending portion and obliquely extending backward into the accommodating cavity, and a supporting portion bending upward and extending from one side of the extending portion. The supporting portion is located below the contact portion. When a non-matching mating connector is inserted into the accommodating cavity, the contact portion abuts the supporting portion, and the supporting portion is configured to block the contact portion from excessive downward deviation.

13 Claims, 8 Drawing Sheets

(56) References Cited

U.S. PATENT DOCUMENTS

| | | | | |
|---|---|---|---|---|
| 7,578,706 | B2 * | 8/2009 | Wang | H01R 13/642<br>439/676 |
| 7,591,688 | B2 * | 9/2009 | Wang | H01R 13/26<br>439/676 |
| 7,708,603 | B1 * | 5/2010 | Little | H01R 13/6464<br>439/676 |
| 7,931,503 | B2 * | 4/2011 | Zhuang | H01R 24/64<br>439/676 |
| 7,985,100 | B2 * | 7/2011 | Jaouen | H01R 24/64<br>439/676 |
| 8,500,478 | B2 * | 8/2013 | Zhang | H01R 13/6272<br>439/344 |
| 9,136,632 | B2 * | 9/2015 | Yu | H01R 13/405 |
| 9,905,972 | B2 * | 2/2018 | Lindkamp | H01R 13/6466 |
| 2005/0009410 | A1 * | 1/2005 | Cheng | H01R 13/64<br>439/676 |

* cited by examiner

100

ELECTRICAL CONNECTOR WITH TERMINALS HAVING SUPPORTING PORTION

CROSS-REFERENCE TO RELATED PATENT APPLICATION

This non-provisional application claims priority to and the benefit of, pursuant to 35 U.S.C. § 119(a), patent application Serial No. CN201720696545.X filed in China on Jun. 15, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an RJ-45 type electrical connector with an anti-misplugging function.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Signal connectors, such as RJ-11 or RJ-45 signal connectors, have been widely used in communications, computer networks, digital communications and other occasions. Because of the simple and convenient combination of a signal plug and a signal socket, the end connection of general communications and networks is mostly achieved by an interconnection between the signal plug and the signal socket, so as to achieve signal connection.

In fact, an RJ-11 signal connector is used for connection between a telephone and a communication network or between a telephone and a handset, and a free end of a signal plug thereof is provided with six terminals in contact with six contact terminals fixed on the RJ-11 signal socket to form signal connection. An RJ-45 signal socket has the same structure as that of the RJ-11 signal socket except that the RJ-45 signal socket has a relatively large size and is provided oppositely with eight contact terminals respectively in contact with eight terminals of the signal plug to meet requirements for such as computer networks or digital communications. Therefore, in signal interconnection, if a user inadvertently inserts an RJ-11 signal plug into an RJ-45 signal socket, two outer sides of the RJ-11 signal plug are straight edge portions, while eight contact terminals extend obliquely upward in an opening of the RJ-45 signal socket, such that the contact terminals on the left and right sides thereof are pushed by the straight edge portions, thus leading to deformation of the contact terminals on the left and right sides, and thereby affecting the quality of the signal connector. In severe cases, contact terminals and terminals cannot be contacted, resulting in interconnection failure.

Therefore, the RJ-45 socket needs an anti-misplugging design in order to prevent the RJ-11 plug from being inserted into the RJ-45 socket and thus causing excessive deformation of the contact terminals on left and right sides of the RJ-45 socket. In an existing design, mostly, a position limiting member is provided separately below a contact portion of the contact terminals on the left and right sides to prevent the contact portion from excessively deviating downward and deforming. For example, the Chinese Patent No. 200710023281.2 discloses an electrical connector, which includes an insulating body, a plurality of conductive terminals and a position limiting member. The insulating body is provided with an accommodating cavity which passes through a wall surface of the insulating body. Each of the terminals includes a contact portion extending into the accommodating cavity. The position limiting member is inserted below the contact portion of the terminal, and an inclined supporting surface is provided thereon to block excessive deviation of the contact portion.

However, the electrical connector has at least the following disadvantages: by separately providing the position limiting member, the components of the electrical connector are increased, thereby increasing the production costs of the electrical connector.

Therefore, a heretofore unaddressed need to design an improved electrical connector exists in the art to address the aforementioned deficiencies and inadequacies.

SUMMARY

In view of the above deficiencies in the background, the invention is directed to an electrical connector with a stop structure provided on a terminal itself, which does not increase components of the electrical connector and reduces production costs of the electrical connector.

To achieve the foregoing objective, the invention adopts the following technical solutions:

An electrical connector includes: an insulating body, provided with an accommodating cavity for insertion of a mating connector; and a plurality of terminals, retained in the insulating body, at least one of the terminals having a retaining portion, an extending portion extending forward from the retaining portion, a contact portion bending upward from a front end of the extending portion and obliquely extending backward into the accommodating cavity, and a supporting portion bending upward and extending from one side of the extending portion, wherein the supporting portion is located below the contact portion, and when a non-matching mating connector is inserted into the accommodating cavity, the contact portion abuts the supporting portion, and the supporting portion is configured to block the contact portion from excessive downward deviation.

In certain embodiments, the supporting portion is provided with a supporting surface configured to abut the contact portion, and an angle is formed between the supporting surface and the extending portion.

In certain embodiments, a height of the supporting portion gradually increases backward from a front thereof.

In certain embodiments, the supporting portion comprises at least one bending portion and a vertical portion, the bending portion bends from one side of the extending portion, and the vertical portion is formed by extending upward from the bending portion.

In certain embodiments, a notch is provided between each of a front end and a rear end of the bending portion and the extending portion.

In certain embodiments, the bending portion is provided with a through slot, the vertical portion is located above the through slot, and an abutting portion extends downward from the vertical portion and is located at one side of an edge of the through slot.

In certain embodiments, the extending portion horizontally extends forward from a front end of the retaining portion, and a lower surface of the abutting portion is parallel to a lower surface of the extending portion.

In certain embodiments, the lower surface of the abutting portion is higher than the lower surface of the extending portion.

In certain embodiments, a gap is provided between the abutting portion and a side wall of the through slot in a front-rear direction.

In certain embodiments, the through slot extends to the extending portion.

In certain embodiments, in a front-rear direction, a distance between two sides of the abutting portion is equal to a distance between two sides of the bending portion.

In certain embodiments, the extending portion comprises a first section located in front of the supporting portion, a second section connected to the contact portion, and a transition section connecting the first section and the second section, a width of the first section gradually decreases forward from a rear thereof, and the width of the second section is smaller than the width of the first section.

In certain embodiments, a width of the second section remains unchanged.

In certain embodiments, a left side and a right side of the transition section have two opposite side walls, and the two side walls comprise two parallel sections parallel to each other, two close sections close to each other, and two arc sections connecting the parallel sections and the close sections, the parallel sections are connected to the first section, and the close sections are connected to the second section.

In certain embodiments, the terminals comprise two outermost terminals, and each of the two outermost terminals has the supporting portion.

Compared with the related art, certain embodiments of the invention have the following beneficial effects:

The terminal is provided with a supporting portion configured to block the contact portion from excessive deviation. The supporting portion is a position limiting structure that is provided on the terminal, which does not increase components of the electrical connector, thus reducing the production cost of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
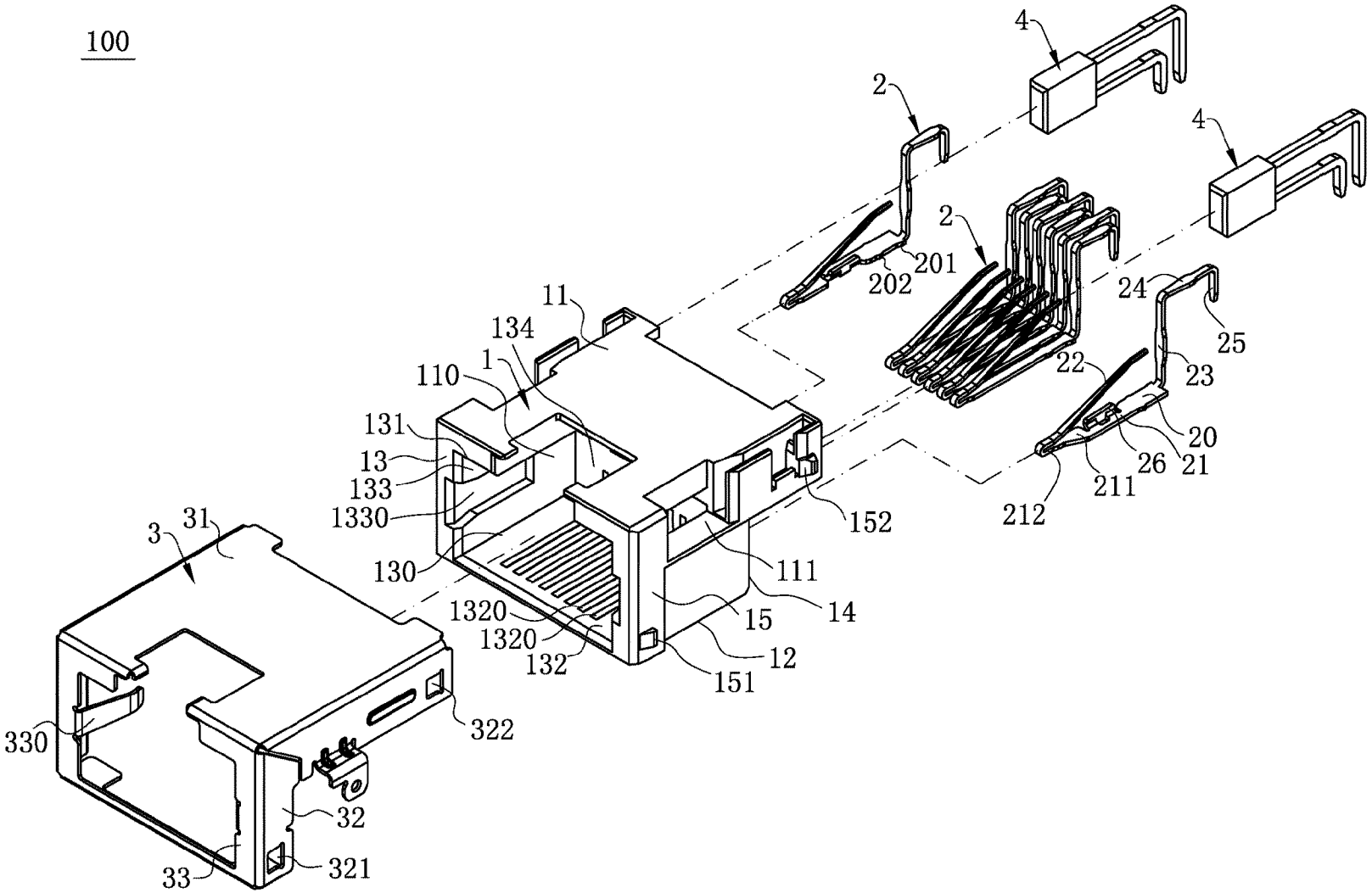
FIG. 1 is a perspective exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

Figure 2:
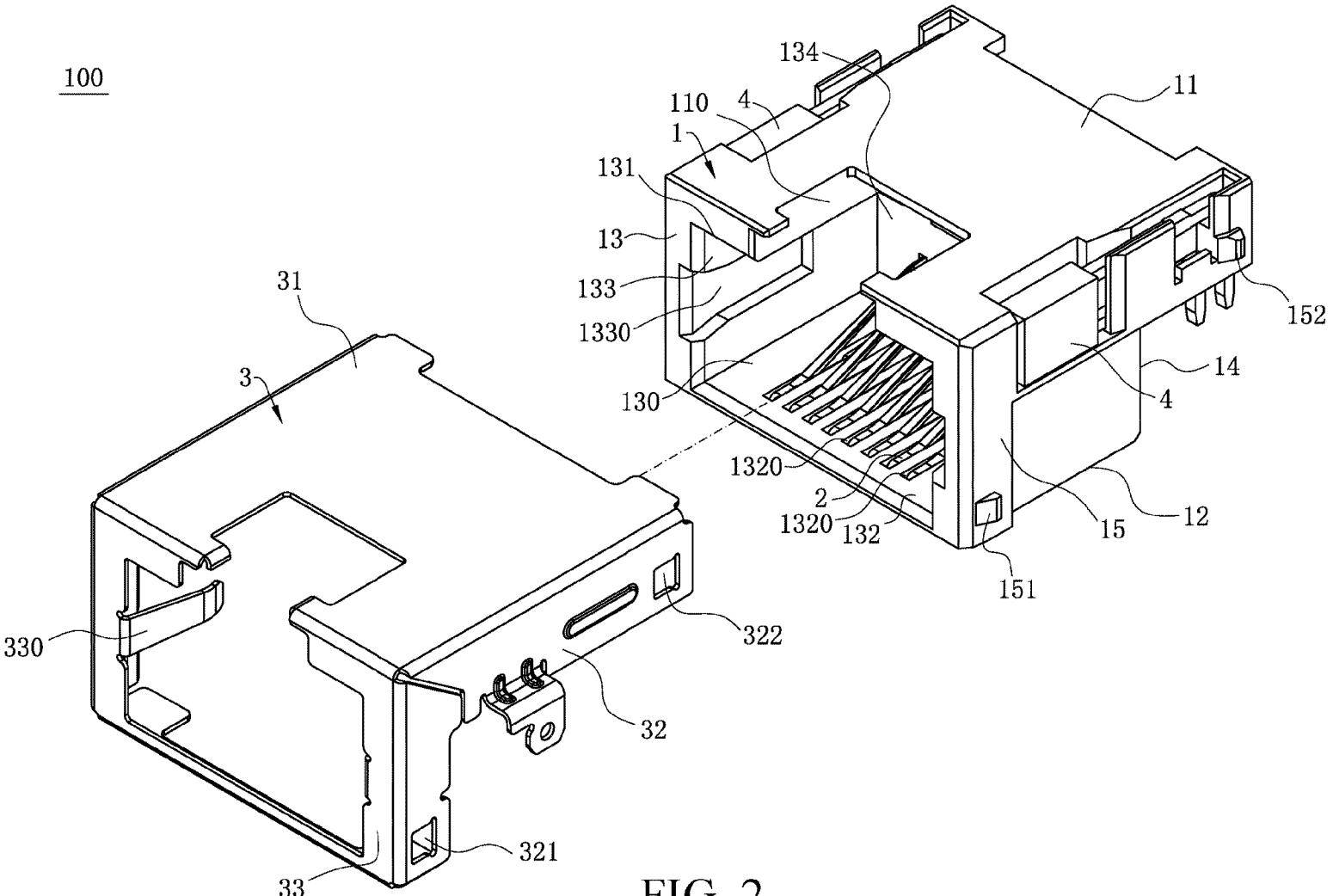
FIG. 2 is another perspective exploded view of an electrical connector according to certain embodiments of the present invention.
Figure 3:
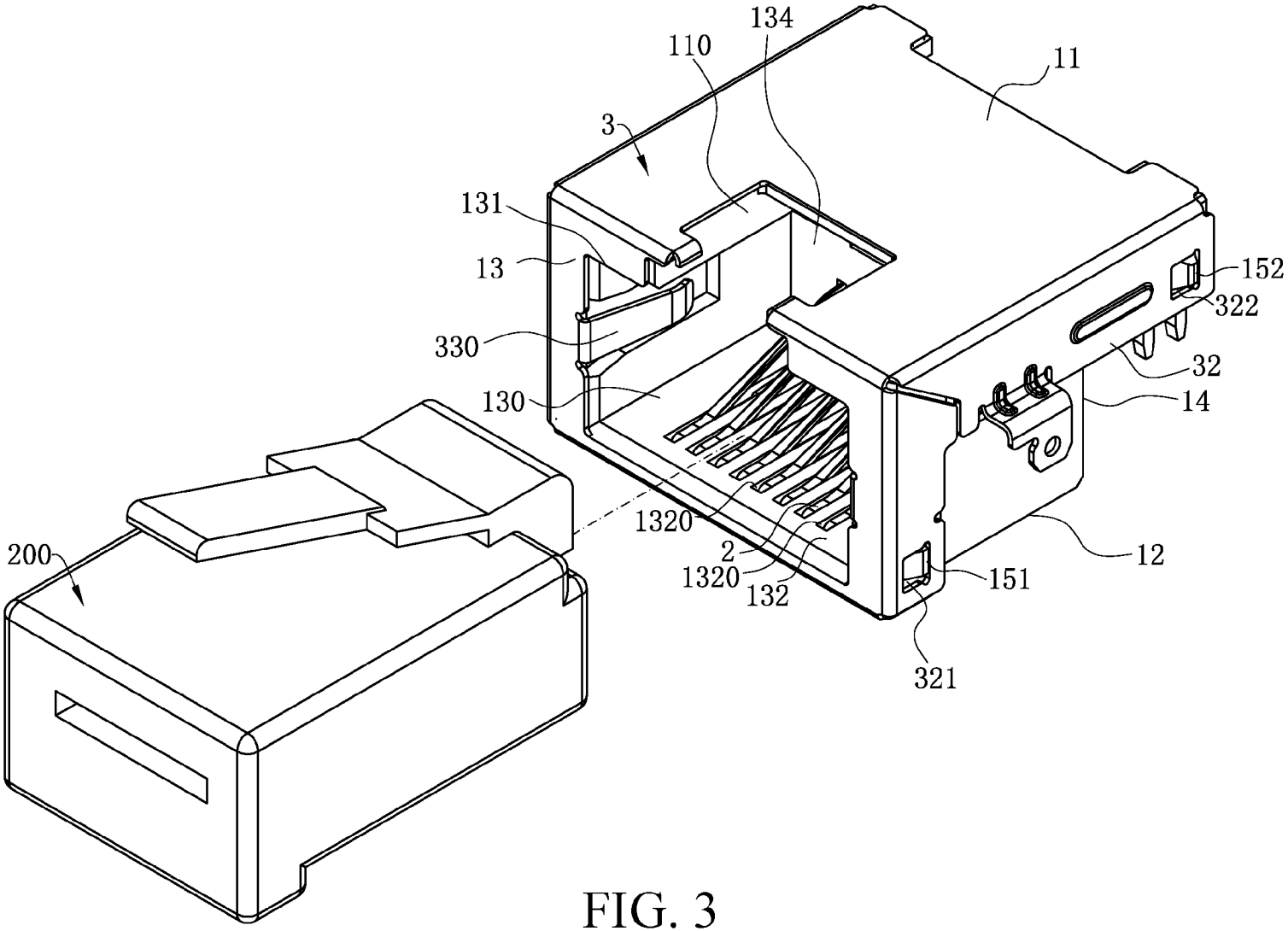
FIG. 3 is a perspective view of an electrical connector according to certain embodiments of the present invention, where an RJ-11 plug connector is not inserted therein.
Figure 4:
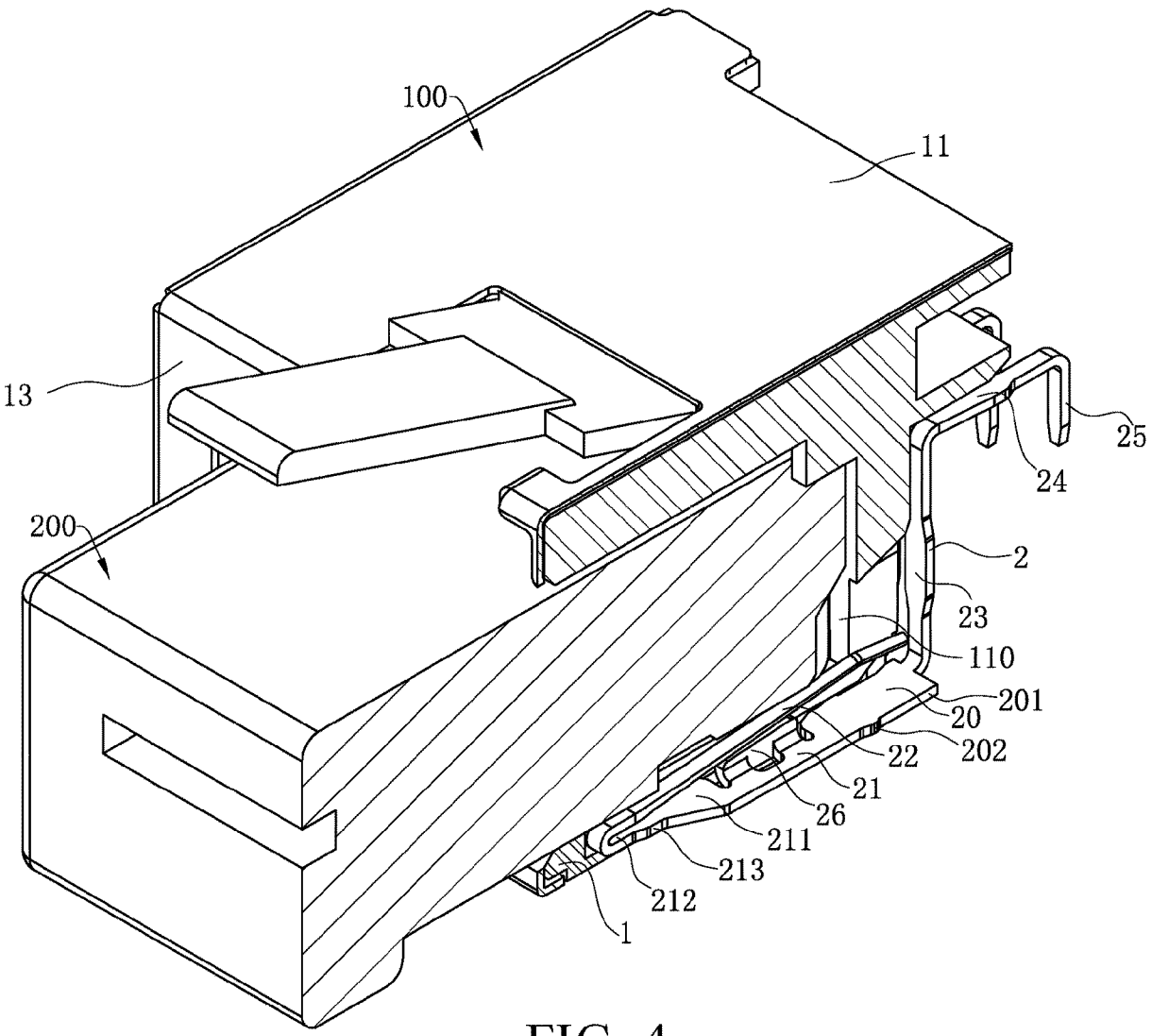
FIG. 4 is a perspective sectional view of an electrical connector according to certain embodiments of the present invention, where an RJ-11 plug connector is inserted therein.

As shown in FIG. 1 to FIG. 3, an electrical connector 100 according to certain embodiment of the present invention is an RJ-45 socket connector, which mainly includes an insulating body 1, a plurality of terminals 2 retained in the insulating body 1, a shielding shell 3 covered outside the insulating body 1, and an LED assembly 4 mounted on a side wall 15 of the insulating body 1.

Figure 6:
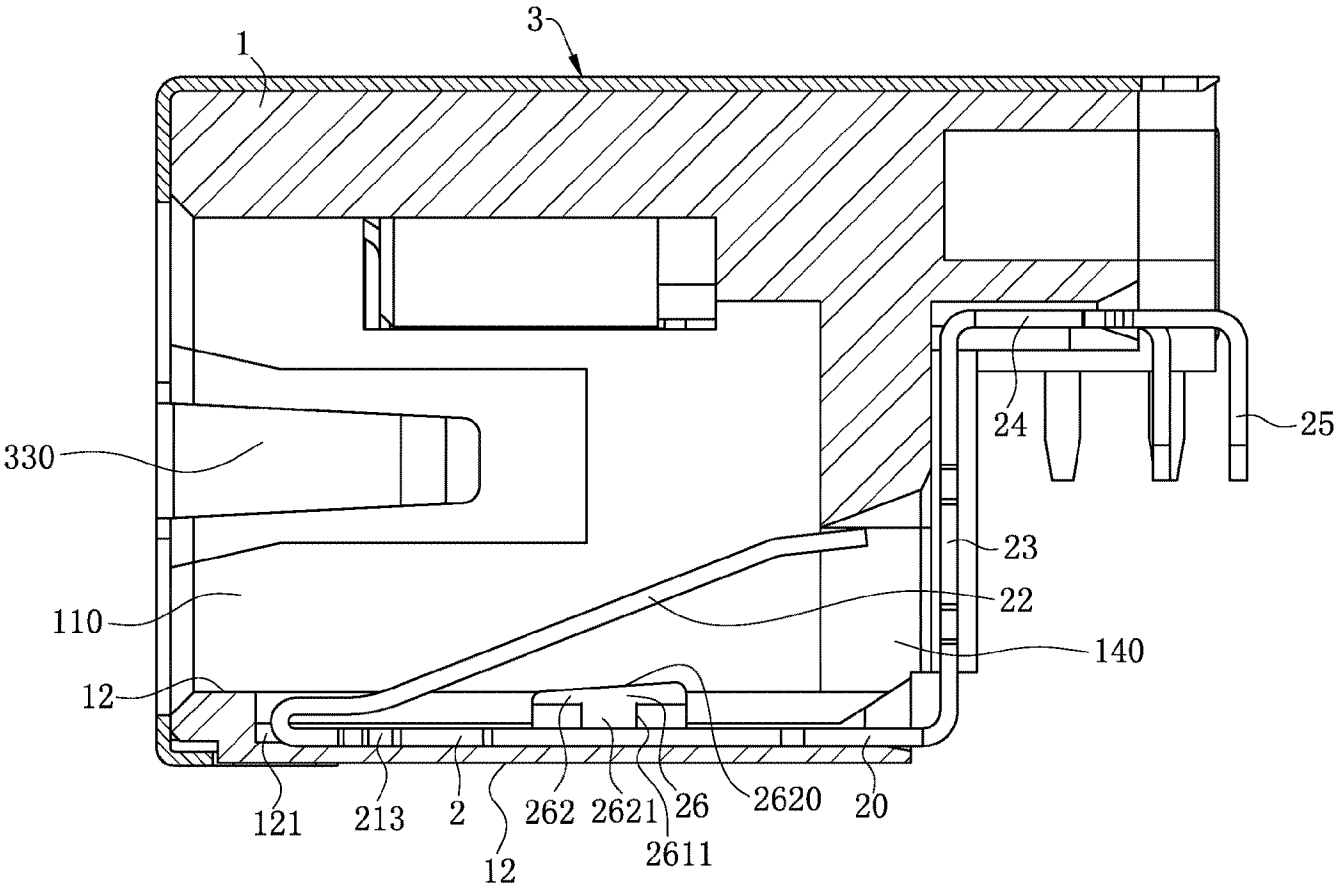
FIG. 6 is a plain sectional view of an electrical connector according to certain embodiments of the present invention.

As shown in FIG. 1, FIG. 2 and FIG. 6, the insulating body 1 is integrally formed, and includes a top wall 11 and a bottom wall 12 opposite to each other, a front wall 13 and a rear wall 14 opposite to each other, and two side walls 15 connecting the top wall 11 and the bottom wall 12 as well as the front wall 13 and the rear wall 14. An accommodating cavity 130 is concavely provided on the front wall 13 and is configured to accommodate an RJ-45 plug connector (not shown) matching the electrical connector 100. The accommodating cavity 130 includes an inner top wall 131 and an inner bottom wall 132 opposite to each other, two inner side walls 133 opposite to each other, and a mating wall 134 parallel to the front wall 13. The inner bottom wall 132 is concavely provided downward with eight retaining slots 1320, and each of the two inner side walls 133 is concavely provided with an accommodating slot 1330. The accommodating slots 1330 communicate with the accommodating cavity 130. The rear wall 14 is provided with eight openings 140 passing through the mating wall 134 and the rear wall 14 in a front-rear direction. The openings 140 communicate with the accommodating cavity 130, and the openings 140 facilitate heat generated by the terminals 2 to diffuse backward from the inside of the accommodating cavity 130. The front end of the top wall 11 is provided with a through hole 110 penetrating downward through the inner top wall 131, and the through hole 110 communicates with the accommodating cavity 130. A connecting location connecting the top wall 11 to the side wall 15 is concavely provided with a mounting slot 111, and the mounting slot 111 communicates with the accommodating cavity 130. The LED assembly 4 is mounted in the mounting slot 111. A front end of each of the two side walls 15 is outward protrudingly provided with a first buckling portion 151, and a rear end of each of the two side walls 15 is outward protrudingly provided with a second buckling portion 152. The second buckling portion 152 is higher than the first buckling portion 151.

As shown in FIG. 1 to FIG. 2, the shielding shell 3 includes a top portion 31, two side portions 32 bending downward and extending from two sides of the top portion 31, and a front end portion 33 connecting the two side portions 32, where the front end portion 33 is located in front of the front wall 13. An elastic sheet 330 bends and extends respectively from each of two sides of the front end portion 33 toward the inside of the accommodating cavity 130, and the elastic sheets 330 are accommodated in the accommodating slots 1330. A front ends of each of the two side portions 32 is provided with a first buckling hole 321, and a rear end of each of the two side portions 32 is provided with a second buckling hole 322, where the first buckling hole 321 accommodates the first buckling portion 151, and the second buckling hole 322 accommodates the second buckling portion 152, such that the shielding shell 3 is buckled and fixed to the insulating body 1.

Figure 5:
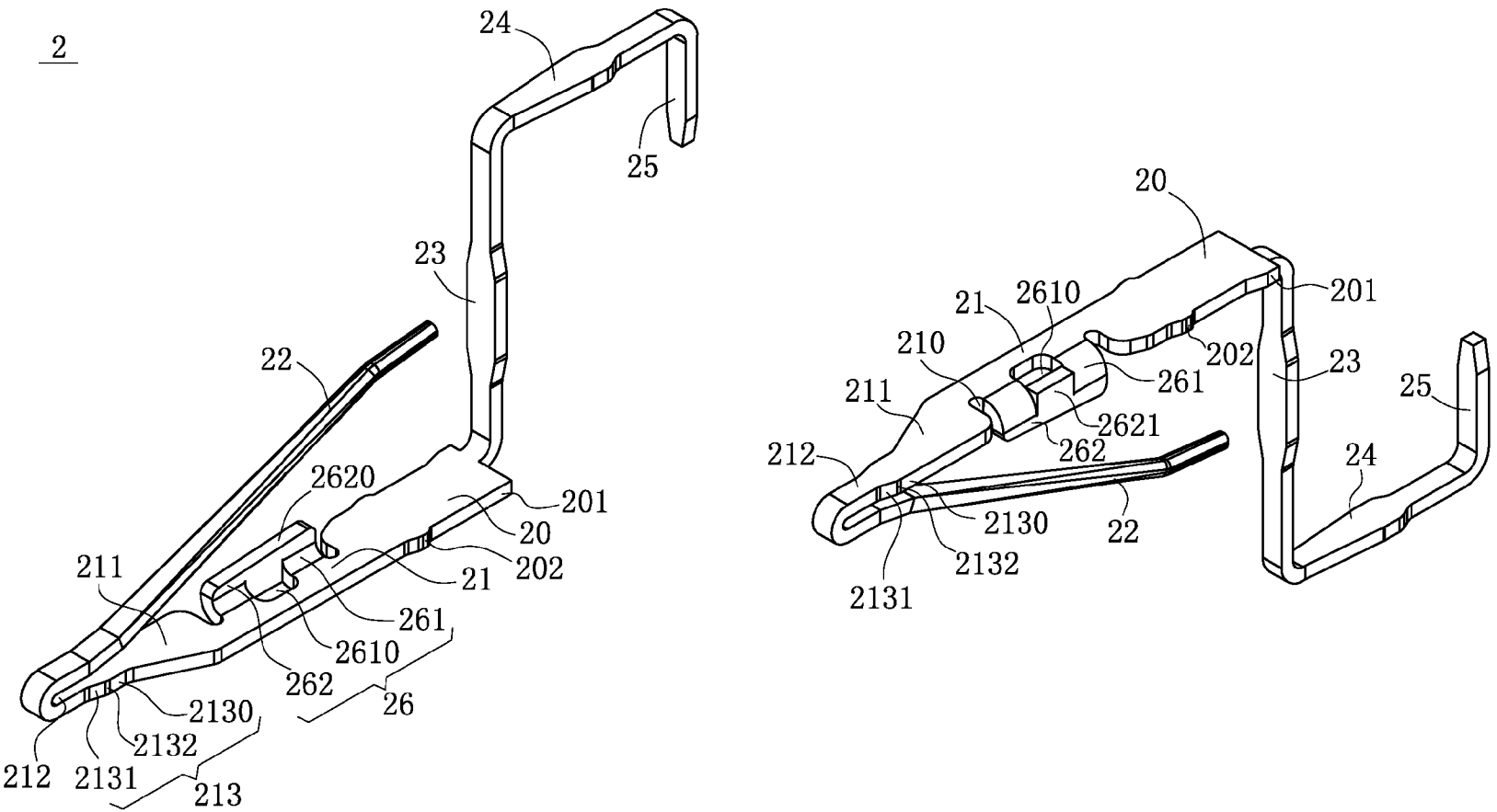
FIG. 5 is a perspective view of a conductive terminal of an electrical connector according to certain embodiments of the present invention.

As shown in FIG. 1 and FIG. 5, at least one of the terminals 2 has a retaining portion 20. An extending portion 21 extends forward from the retaining portion 20. In this embodiment, the extending portion 21 horizontally extends forward from a front end of the retaining portion 20, and the retaining portion 20 and the extending portion 21 are each flat plate shaped. A contact portion 22 bends upward from a front end of the extending portion 21 and obliquely extends backward into the accommodating cavity 130, and the contact portion 22 and the extending portion 21 substantially form a 45-degree angle. An end section of the contact portion 22 is accommodated in a corresponding one of the openings 140, and a top wall of the opening 140 is located above an end section of the contact portion 22 to limit the position of the contact portion 22 when a mating connector is not inserted. A first connecting portion 23 bends upward and extends from a rear end of the retaining portion 20. A second connecting portion 24 bends backward and extends from the first connecting portion 23. A soldering portion 25 bends downward and extends from the second connecting portion 24. There are eight terminals 2, which are accommodated in a row in the insulating body 1. The retaining portion 20 and the extending portion 21 of each of the terminals 2 are accommodated in the corresponding retaining slot 1320. A width of the contact portion 22 gradually decreases in an extending direction thereof. Each of left and right sides of the retaining portion 20 is provided with a first protruding portion 201 and a second protruding portion 202 respectively protruding outward, and the second protruding portion 202 is located in front of the first protruding portion 201. A maximum width between outer sides of the first protruding portion 201 is greater than a maximum width between outer sides of the second protruding portion 202, such that the terminal 2 is stably retained in the corresponding retaining slot 1320.

Figure 7:
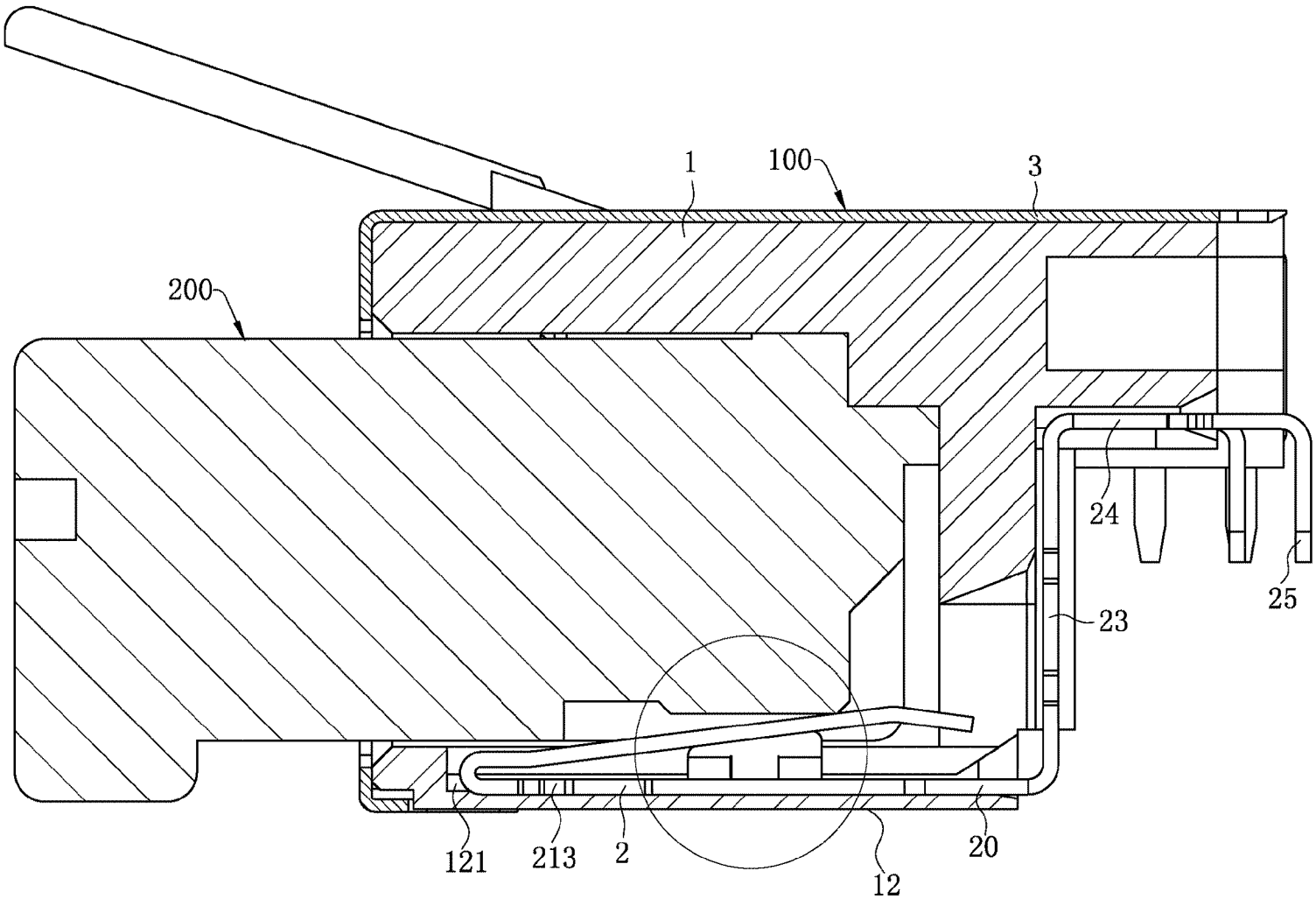
FIG. 7 is a plain sectional view of an electrical connector according to certain embodiments of the present invention, where an RJ-11 plug connector is inserted therein.
Figure 8:
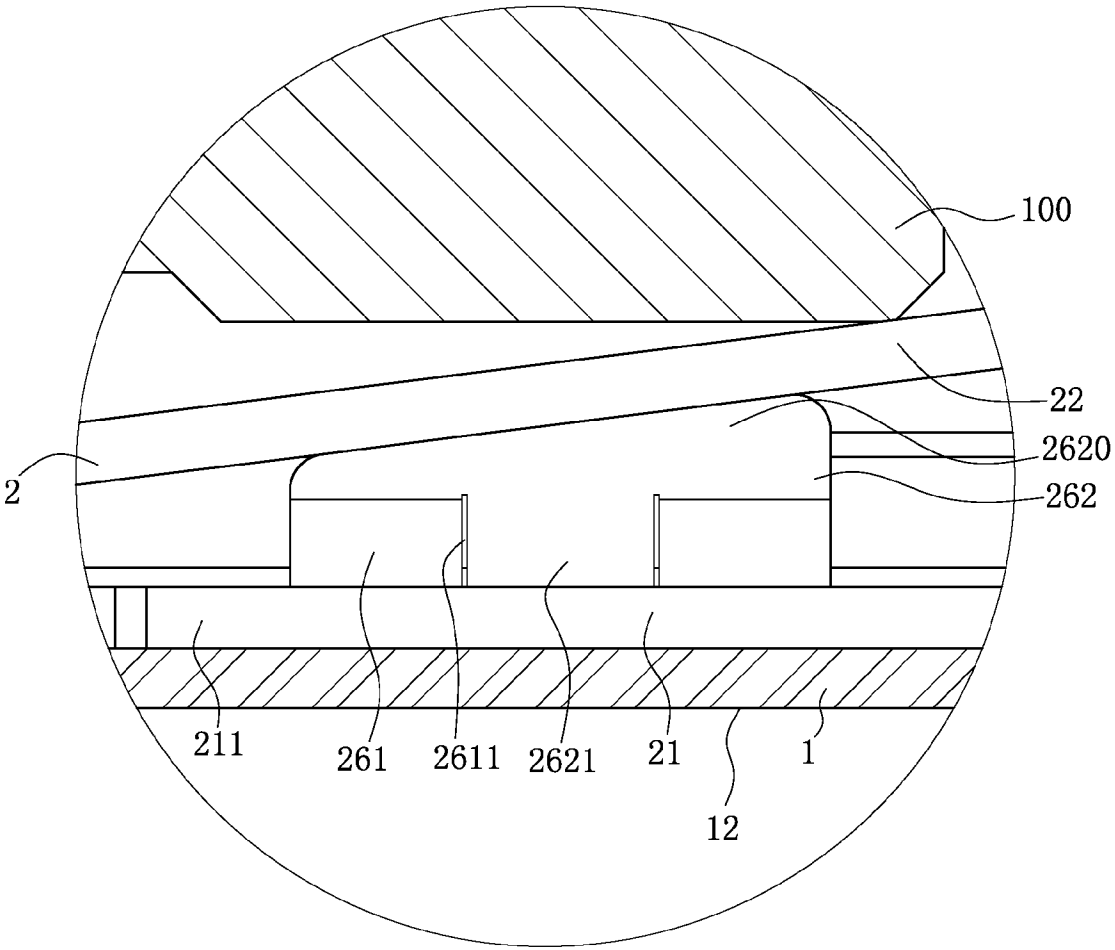
FIG. 8 is a partial enlarged view of FIG. 7.

As shown in FIG. 5 to FIG. 7, the terminals 2 include two outermost terminals 2 located at the left and right outermost sides of the terminals 2, A supporting portion 26 bends upward and extends from one side of the extending portion 21 of each of the two outermost terminals 2, and a height of the supporting portion 26 gradually increases backward from a front thereof. The supporting portion 26 includes a bending portion 261 and a vertical portion 262. The bending portion 261 bends from one side of the extending portion 21. The vertical portion 262 is formed by extending upward from the bending portion 261, and two ends of the top portion 31 on the vertical portion 262 are arc-shaped. An upper surface of the vertical portion 262 is a supporting surface 2620 abutting the contact portion 22, and an angle is formed between the supporting surface 2620 and the extending portion 21. When an RJ-11 plug 200 is inserted into the electrical connector 100, the straight plastic seats on left and right sides of the RJ-11 plug 200 press the contact portions 22 of the terminals 2 on left and right sides of the electrical connector 100, and the supporting surface 2620 abuts the contact portions 22 to prevent the contact portions 22 from deviating downward excessively.

As shown in FIG. 5, a notch 210 is provided between each of front and rear ends of the bending portion 261 and the extending portion 21, which facilitates the press forming of the bending portion 261. The bending portion 261 is provided with a through slot 2610 extending to the extending portion 21. In a front-rear direction, the through slot 2610 is located in a middle of the bending portion 261. An abutting portion 2621 extends downward from the vertical portion 262. That is, the abutting portion 2621 extends vertically downward. The vertical portion 262 is located above the through slot 2610, and the abutting portion 2621 is located at one side of an edge of the through slot 2610. In the front-rear direction, a distance between two sides of the abutting portion 2621 is equal to a distance between two sides of the bending portion 261. A lower surface of the abutting portion 2621 is parallel to a lower surface of the extending portion 21. That is, the lower surface of the abutting portion 2621 is a horizontal surface. The lower surface of the abutting portion 2621 is higher than the lower surface of the extending portion 21. That is, a gap is formed between the lower surface of the abutting portion 2621 and a bottom surface of the retaining slot 1320, thus allowing the terminal 22 to be easily mounted into the corresponding retaining slot 1320. When the RJ-11 plug 200 is inserted into the electrical connector 100, pressure on the supporting surface 2620 is transmitted to the abutting portion 2621, such that the abutting portion 2621 is pressed and moves downward, and abuts the bottom surface of the corresponding retaining slot 1320, thus supporting the supporting portion 26 to prevent the supporting portion 26 from being deformed by excessive pressure. As the abutting portion 2621 extends vertically downward and the lower surface of the abutting portion 2621 is parallel to the lower surface of the extending portion 21, a better supporting effect can be provided, such that the entire supporting portion 26 is subjected to uniform force and is not easily deformed, and the supporting portion 26 has a better effect of supporting the contact portion 22. There is a gap 2611 between the abutting portion 2621 and a side wall of the through slot 2610 in the front-rear direction.

As shown in FIG. 5, the extending portion 21 includes a first section 211 located in front of the supporting portion 26, a second section 212 connected to the contact portion 22, and a transition section 213 connecting the first section 211 and the second section 212. A width of the first section 211 gradually decreases forward from a back thereof, a width of the second section 212 remains unchanged, and the width of the second section 212 is smaller than the width of the first section 211. Left and right sides of the transition section 213 have two opposite side walls. The two side walls include two parallel sections 2130 parallel to each other, two close sections 2131 close to each other, and two arc sections 2132 connecting the parallel sections 2130 and the close sections 2131. The parallel sections 2130 are connected to the first section 211, and the close sections 2131 are connected to the second section 212.

To sum up, the electrical connector 100 according to certain embodiments of the present invention has the following beneficial effects:

(1) The extending portion 21 of at least one of the terminals 2 bends upward and extends, and the supporting portion 26 located below the contact portion 22 is provided for supporting the contact portion 22 to prevent the contact portion 22 from deviating excessively downward. Compared with the arrangement of providing a separate position limiting member, the components of the electrical connector 100 are reduced and the production costs of the electrical connector 100 are reduced.

(2) The supporting portion 26 is formed by bending and extending upward from the extending portion 21, and an acting force on the contact portion 22 when the RJ-11 plug 200 is inserted can be transmitted to the extending portion 21, ensuring that the supporting portion 26 stably supports the contact portion 22.

(3) A notch 210 is provided between each of the front and rear ends of the bending portion 261 and the extending portion 21, which facilitates press forming of the bending portion 261.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, provided with an accommodating cavity for insertion of a mating connector; and a plurality of terminals, retained in the insulating body, at least one of the terminals having a retaining portion, an extending portion extending forward from the retaining portion, a contact portion bending upward from a front end of the extending portion and obliquely extending backward into the accommodating cavity, and a supporting portion bending upward and extending from one side of the extending portion, wherein the supporting portion is located below the contact portion, and when a non-matching mating connector is inserted into the accommodating cavity, the contact portion abuts the supporting portion, and the supporting portion is configured to block the contact portion from excessive downward deviation, wherein the supporting portion comprises a bending portion and a vertical portion, the bending portion bends from one side of the extending portion, the vertical portion is formed by extending upward from the bending portion, the bending portion is provided with a through slot, the vertical portion is located above the through slot, and an abutting portion extends downward from the vertical portion.

2. The electrical connector according to claim 1, wherein the supporting portion is provided with a supporting surface configured to abut the contact portion, and an angle is formed between the supporting surface and the extending portion.

3. The electrical connector according to claim 1, wherein a height of the supporting portion gradually increases backward from a front thereof.

4. The electrical connector according to claim 1, wherein a notch is provided between each of a front end and a rear end of the bending portion and the extending portion.

5. The electrical connector according to claim 1, wherein the extending portion horizontally extends forward from a front end of the retaining portion, and a lower surface of the abutting portion is parallel to a lower surface of the extending portion.

6. The electrical connector according to claim 1, wherein the lower surface of the abutting portion is higher than the lower surface of the extending portion.

7. The electrical connector according to claim 1, wherein a gap is provided between the abutting portion and a side wall of the through slot in a front-rear direction.

8. The electrical connector according to claim 1, wherein the through slot extends to the extending portion.

9. The electrical connector according to claim 1, wherein in a front-rear direction, a distance between two sides of the abutting portion is equal to a distance between two sides of the bending portion.

10. The electrical connector according to claim 1, wherein the extending portion comprises a first section located in front of the supporting portion, a second section connected to the contact portion, and a transition section connecting the first section and the second section, a width of the first section gradually decreases forward from a rear thereof, and the width of the second section is smaller than the width of the first section.

11. The electrical connector according to claim 10, wherein a width of the second section remains unchanged.

12. The electrical connector according to claim 10, wherein a left side and a right side of the transition section have two opposite side walls, and the two side walls comprise two parallel sections parallel to each other, two close sections close to each other, and two arc sections connecting the parallel sections and the close sections, the parallel sections are connected to the first section, and the close sections are connected to the second section.

13. The electrical connector according to claim 1, wherein the terminals comprise two outermost terminals, and each of the two outermost terminals has the supporting portion.

* * * * *